United States Patent [19]

Hibbard

[11] 4,174,010

[45] Nov. 13, 1979

[54] ROCK DRILL

[75] Inventor: George A. Hibbard, Claremont, N.H.

[73] Assignee: Joy Manufacturing Company, Pittsburgh, Pa.

[21] Appl. No.: 824,597

[22] Filed: Aug. 15, 1977

Related U.S. Application Data

[63] Continuation of Ser. No. 625,540, Oct. 24, 1975, abandoned.

[51] Int. Cl.[2] ..... E21C 7/10

[52] U.S. Cl. ..... 173/78; 92/181 P; 173/80; 173/134

[58] Field of Search ..... 92/144, 158, 181 P; 173/78, 80, 134

[56] References Cited

U.S. PATENT DOCUMENTS

| | | | |
|---|---|---|---|
| 3,881,557 | 5/1975 | Gendron et al. | 173/131 |
| 3,908,767 | 9/1975 | Klemn | 173/78 |
| 3,939,943 | 2/1976 | Salmi | 173/DIG. 3 |

*Primary Examiner*—William Pate, III

*Attorney, Agent, or Firm*—J. Stewart Brams

[57] ABSTRACT

A percussive rock dill and more particularly a percussive rock drill having improved means for passing a flow of flushing fluid therethrough.

12 Claims, 1 Drawing Figure

ROCK DRILL

Figure 1:
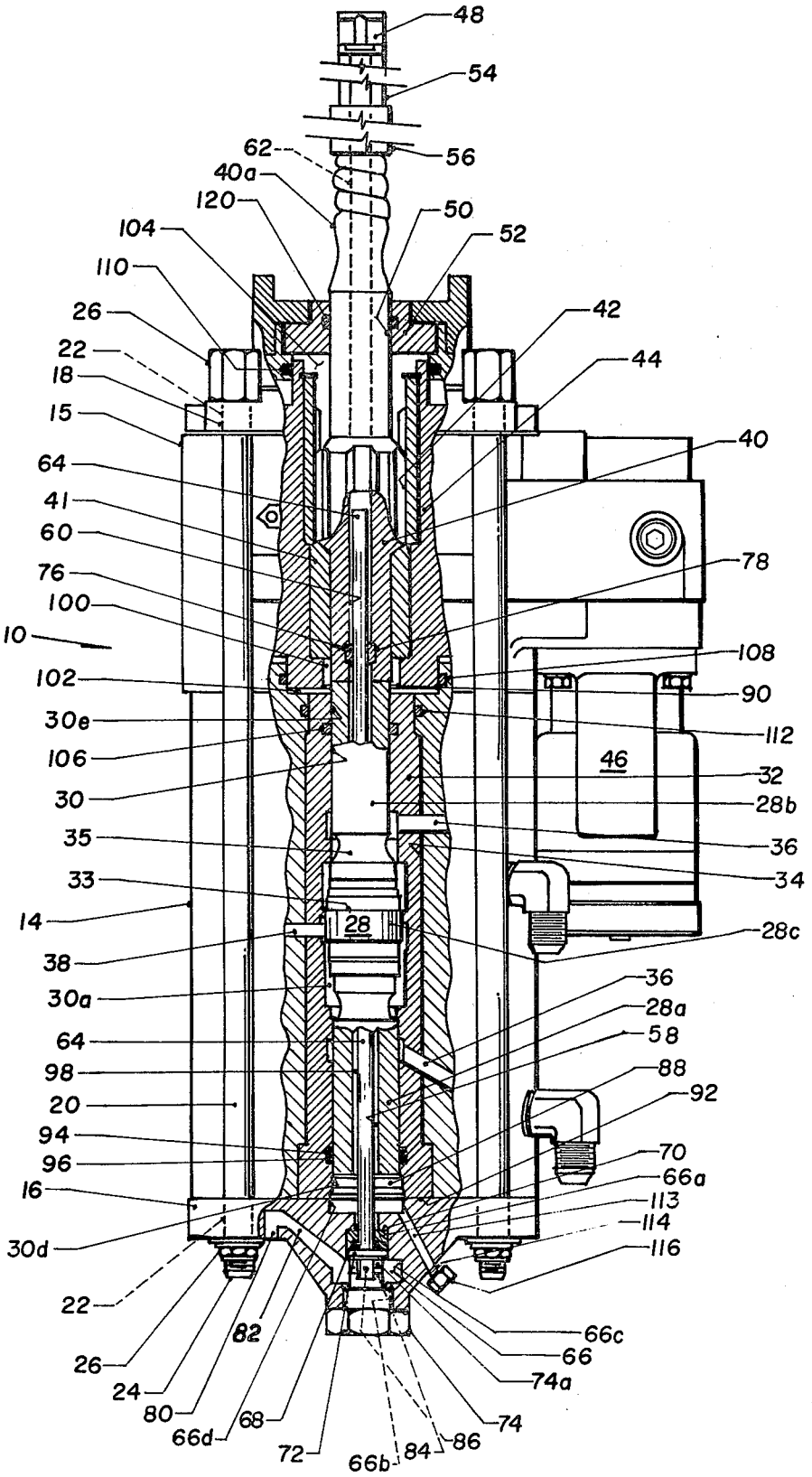

This is a continuation of application Ser. No. 625,540, filed 10-24-75 now abandoned.

In the art of earth boring by percussive tool means such as in rock drilling it has long been common practice to direct a flow of flushing fluid to the work surface during ongoing drilling operations to flush detritus from the bore hole and to cool the drill bit. For example, many known rock drills have included axially aligned communicating bores in the hammer piston, striking element and drill steel whereby a desirably simple and compact means has been provided for directing a flow of flushing fluid such as water to the bottom of the bore hole as well as for such additional purposes as the dissipation of heat generated within the drill. Although such flushing fluid arrangements have generally served the purposes intended, they have nonetheless often been subject to certain undesirable deficiencies. For example, the flow of flushing fluid through the drill has not in all cases dissipated heat generated within the drill casing as effectively as would be desirable. Furthermore, such arrangements have commonly included a water tube extending within the axially aligned bores in the hammer piston and striking element and having sealing means to protect internal drill portions from damage due to the entry of water thereinto during operation. Heretofore there has been no effective backup sealing means to protect the drill interior from water damage in the event of primary water tube seal failure.

The present invention provides means for passing flushing fluid to the bottom of a bore hole through communicating bores in the drill hammer piston, striking element and drill steel whereby the cited deficiencies of the prior art, as well as others not specifically cited, are alleviated. To this end there is provided within the scope of the present invention fluid means cooperable with a rock drill hammer piston for improved heat transfer from the drill to the flushing fluid passing therethrough. The fluid means of this invention furthermore acts as a backup seal to protect the drill in the event of water tube seal failure.

There and other objects and advantages of the present invention will become more readily apparent upon a reading of the following description of the invention as shown in the sole accompanying FIGURE which illustrates in side elevation and in partial longitudinal section a rock drill constructed in accordance with the principles of the invention described.

There is generally indicated at 10 in the FIGURE a percussive rock drill powered by fluid motor means which, it is to be understood from the outset, comprises but one of numerous fluid motor configurations adaptable for use in conjunction with the present invention. The drill 10 is illustrated in simplified form solely for purposes of clarity, and of course such simplification is not intended to unduly limit the scope of the invention described. Accordingly, as shown the drill 10 comprises an elongated, generally annular body member or motor casing 14 disposed axially adjacent a generally annular chuck housing 15. The casing 14 and housing 15 are disposed axially intermediate a generally disc-like backhead 16 and a generally disc-like front head 18 and rigidly secured therebetween as by a plurality of longitudinally extending side rods 20. As shown, rods 20 retain the casing 14 and housing 15 axially adjacent from each other and axially intermediate the respective front head and backhead 18, 16 by means of threaded end portions 24 thereof which pass through suitably aligned bores 22 in the front head and backhead and have cooperably threaded nut members 26 engaged thereupon to fixedly retain members 16, 14, 15 and 18 in the configuration described and in forceful compressive engagement with each other.

As noted hereinabove, the motor of drill 10 may take the form of any of various well known designs comprising generally a hammer piston element reciprocably carried for controlled repetitive impacting upon a striking element. For purposes of illustrative simplicity the drill herein is shown as having a motor of the so-called "valveless distribution" type wherein a generally stepped cylindrical hammer piston 28 is carried for reciprocal movement within an axial through bore portion 30 of a generally elongated annular liner 32 fixedly disposed within an axial through bore 34 in the casing 14 and substantially axially coextensive therewith. As shown the piston 28 includes axially spaced apart rearward and forward stem portions **28*a*, 28*b*, respectively, and an enlarged intermediate portion 28*c* having lands as at 33 and adjacent grooves 35 disposed for reciprocal movement within an intermediate, generally stepped control portion 30*a* of bore 30. Bore portion 30*a* communicates via suitable pressure port means 36 and exhaust port means 38 with any suitable pressure fluid system (not shown) such as a hydraulic-fluid flow source whereby the reciprocal movement of the piston 28 causes lands 33 and grooves 35 to cyclically open and close the ports 36, 38 thus directing motive fluid flow to sustain piston reciprocation in the generally well known manner of valveless cycle fluid motors. Inasmuch as such valveless motors are well known to those versed in the art further detailed description thereof is omitted herefrom. Suffice it to note in this regard that in operation the self-sustained reciprocal movement of piston 28 produces repetitive impacts of the forward stem 28*b* upon a striking element shown as a striking bar 40 which is rotatably carried in any suitable manner within housing 15 as by splined engagement at 42 within an annular chuck gear 44 which is journalled in bearings (not shown) for rotation within the housing 15. Any suitably adapted rotation means such as a fluid rotation motor 46 and cooperable gear train (not shown) carried by housing 15 may be utilized to drive the gear 44 and striking bar 40 in rotation whereby a rotary impact drilling action is generated. A forward end portion 40*a* of striking bar 40 extends forwardly of front head 18 through an axial through bore 50 in a front bushing member 52 and has a drill steel 54 axially, rigidly affixed thereto as by a known coupling sleeve 56. Drill steel 54 in turn has a drill bit 48 rigidly affixed adjacent a forwardmost end portion thereof whereby the rotary impact drilling action of drill 10 is transmitted directly to bit 48** for drilling into rock formations in the known manner.

The drill 10 includes means for delivering flushing liquid such as water to the drill bit 48 comprised of an axial through bore 58 extending within piston 28 and communicating with an axially aligned through bore 60 extending within the striking bar 40. Bore 60 in turn communicates with an axial through bore 62 extending within the drill steel 54 whereby flushing liquid may be directed to the bit 48 via a continuous axially extending path comprised of the respective bores 58, 60 and 62.

To protect internal components of drill 10 from the entry of flushing water thereinto, the water passing through bore 58 flows within a water tube 64 disposed within the bore 58 and extending forwardly into bore 60. The tube 64 also extends rearwardly into a generally stepped, axial through bore 66 extending within backhead 16.

The tube 64 is provided with sealing means adjacent opposed longitudinal end portions thereof within bores 66 and 60 whereby the motor components contained within casing 14 are completely isolated from flushing water passed through the tube 64. The rearward sealing means is shown as comprising a suitably resilient annular seal 68 surrounding tube 64 within an enlarged portion 66*a* of bore 66 and axially intermediate a radially inwardly extending shoulder 70 which defines the forward end of bore portion 66*a*, and a radially outwardly flared end portion 72 of tube 64. A water tube clamping member 74 is threadingly engaged within a rearwardmost threaded end portion 66*b* of bore 66 whereby a forward end 74*a* of the member 74 forcefully engages flared end 72 to captively retain seal 68 intermediate shoulder 70 and the end portion 72 to effectively seal the annular space radially intermediate tube 64 and bore 66.

Adjacent the forward end of tube 64 within bore 60 a suitable seal such as resilient wiping seal 76 is provided in a form of an annulus sealingly seated within an annular groove 78 spaced forwardly from the rearwardmost end of bore 60. Seal 76 surrounds the tube 64 and extends in sealing engagement radially intermediate the tube 64 and groove 78.

It will be understood that flushing water may be introduced into the rearwardmost end of tube 64 in any conventional manner as through an inlet port 80 communicating with any suitable water pressure source (not shown) and further communicating via open passages 82 formed in backhead 16 with an enlarged annular bore portion 66*c* of bore 66. Bore portion 66*c*, in turn, communicates via suitably formed transverse passages 84 and a forwardly extending axial passage 86 in member 74 with the tube 64 whereby in practice the flushing water is directed under pressure through tube 64 and thence to the drill bit 48.

To protect the drill components within casing 14 from water damage in the event of water tube seal failure, there is provided by the instant invention a fluid pressure sealing means wherein a pressurized charge of gas, air for example, is employed to back up the water tube seals as follows.

Within bore 30 in which piston 28 reciprocates there are formed chambers 88 and 90 adjacent opposed longitudinal ends thereof to receive respective piston stems 28*a*, 28*b* during the reciprocal travel of the piston 28 in operation. The chamber 88, shown as being formed within a rearward enlarged end portion 30*d* of bore 30 and an adjacent enlarged forward end portion 66*d* of bore 66, is sealed against fluid leakage therefrom by means of the previously described rearward water tube seal 68 and additionally by such suitable sealing means as a metallic face seal formed intermediate adjacent surfaces of backhead 16 and liner 32 as at 92 radially outwardly adjacent the chamber 88, and an annular wiping seal 94 disposed within an annular groove portion 96 of bore 30 forwardly of chamber 88 and surrounding piston stem 28*a* in sealing engagement therewith. Accordingly, the chamber 88 is sealed against the escape of gas therefrom by any path except through an annular clearance 98 which is provided intermediate the exterior wall of tube 64 and the bore 58 and extends longitudinally to communicate intermediate chambers 88 and 90.

Chamber 90 is formed in a manner similar to chamber 88, being formed within a forward end portion 30*e* of bore 30, and within forwardly adjacent internal peripheral portions of the chuck gear 44 as at 100 radially intermediate the striking bar 40 and the internal periphery of gear 44. As shown, the chamber 90 may additionally comprise spaces axially intermediate bore portion 30*e* and space 100 as for example space 102 extending axially intermediate the forward ends of casing 14 and liner 32, and the adjacent rearward end of gear 44, or further portions of the voids within the interior periphery of gear 44 as at 104 adjacent a forward end portion thereof. It is to be understood that the components normally disposed within the gear 44 such as striking bar 40 and a rear bushing 41 for example, do not provide a sealing fit therewithin and clearances are thus maintained which provide for relatively free flow of gas throughout the entire chamber 90 intermediate the axial ends of the gear 44.

The chamber 90 is sealed against the escape of gas therefrom by the previously described forward water tube seal 76 and by additional seals shown as including: an annular piston stem wiping seal 106 similar in all respects to the previously described seal 94; an annular wiping seal 108 interposed radially intermediate relatively rotating portions of gear 44 and casing 14 adjacent a rearward end of gear 44; an entirely similar wiping seal 110 disposed radially intermediate a forward end portion of gear 44 and housing 15; an annular seal 112 disposed radially intermediate liner 32 and casing 14 adjacent a forward end portion thereof; and an annular wiping seal 120 disposed radially intermediate striking bar 40 and chuck housing 52 within bore 50.

It will be seen that by means of the sealing arangements provided, chambers 88 and 90 are completely sealed against the exit of gas therefrom except that gas may flow between chambers 88 and 90 via clearance 98 extending therebetween within piston 28. Thus, a charge of pressurized gas may be maintained therewithin to provide improved sealing according to one feature of the instant invention. In order to introduce such gas into the chambers 88 and 90 there may be provided gas inlet means shown as inlet passage 113 formed within backhead 16 and communicating with chamber 88, and having a gas line connection 114 whereby an external source of pressurized gas may be applied to introduce air or other gas into the chambers 88, 90 via passage 113. The connection 114 is shown as being sealingly closed by a cap 116 to preclude escape of contained gas to the atmosphere.

The gas introduced into the chambers 88 and 90 preferably is under positive pressure somewhat higher than the flushing water pressure whereby the large and undesirable extruding forces of the flushing water upon the water tube seals 68, 76 are effectively cancelled by the opposed gas pressure. In addition, the pressure differential by which the pressure of the gas within chambers 88, 90 exceeds the flushing water pressure provides a small net outward pressure at all times across the respective water tube seals 76, 68 such that a failure of one or both of these seals will result in a flow of gas outwardly from chambers 88, 90 thereby precluding any entry of flushing water thereinto.

According to an additional feature of the instant invention, as piston 28 reciprocates in operation and the stems 28*a* and 28*b* alternately move into and out of the respective chambers 88 and 90, some of the gas contained within the respective chambers 88, 90 is cyclically pumped therebetween through the clearance 98, the chamber 88 being partially emptied of gas and the chamber 90 being filled on piston upstroke, and the chamber 90 being partially emptied and chamber 88 being filled on the piston downstroke. This pumping of gas between chambers 88 and 90 improves heat dissipation from the drill 10 and ensures uniform temperature of the piston 28 inasmuch as heat transfer from the piston 28 to the flowing gas occurs uniformly along the length thereof as the gas flows through passage 98 intermediate chambers 88, 90. The heat is thence uniformly conducted from the flowing gas to the flushing water through the wall of tube 64 along substantially the entire length thereof. Furthermore, by suitable sizing of chambers 88, 90 and clearance 98 the described cyclic pumping of gas may be made to create turbulent gas flow which further enhances heat transfer from the drill 10 to the flowing water. Such turbulent gas flow decreases the thermal insulating capability of the flowing gas as by breaking up the boundary gas layer adjacent the periphery of bore 60 and tube 64.

Of course it will be appreciated that the communicating passage 98 between chambers 88 and 90 need not take a form of a clearance around water tube 64. For example, the described heat transfer advantages may be provided for by a separate passage or plurality of passages extending within piston 28 and communicating with tube 64 in lieu of or in addition to the clearance 98. Additionally, it should be appreciated that the described heat dissipation of gas pumping is operable with any number of gases over a wide range of gas pressures including air at atmospheric pressure.

According to the foregoing description there is provided novel means for dissipating heat from interior portions of a percussive rock drill and means for guarding against the entry of flushing liquid thereinto in the event of a seal failure along the flushing liquid path therethrough. Notwithstanding the reference herein to a specific preferred embodiment of the invention, it is of course to be appreciated that the invention being broadly conceived is subject to various modifications of the described embodiment. For example, the form of piston 28 may be varied within a wide design latitude, chambers 88 and 90 may be independently pressurized and need have no communication therebetween for purposes of the described water tube sealing feature, chambers 88 and 90 may be adapted to communicate continuously with a reservoir of gas pressure, chambers 88, 90 might be supplemented by additional variable volume chambers and additional passageway means communicating between such additional chambers and chambers 88, 90, the striking element might be an anvil block in lieu of striking bar 40 and need not necessarily be rotatably carried, and the like. These and other embodiments and modifications having been envisioned and anticipated by the inventor it is respectively requested that the invention be interpreted broadly and limited only by the scope of the claims appended hereto.

What is claimed is:

1. A fluid motor comprising: a body member; an elongated piston axially reciprocally movable within said body member; said body member including motive fluid conducting means cooperable with a source of motive fluid flow for conducting motive fluid to said piston to reciprocally drive said piston; elongated fluid conveying means extending within said body member and said piston; a sealed containment means defined within said motor and adapted to contain therein a quantity of heat transfer medium in isolation from said motive fluid conducting means; said containment means including a pair of variable volume chambers and passageway means communicating between said pair of variable volume chambers; said passageway means including a passage portion extending within said piston such that the heat transfer medium contained in said passage portion is maintained in heat exchange relation with said fluid conveying means; and said piston including means effective to induce a flow of such heat transfer medium within said passage portion during the reciprocal movement of said piston by increasing the volume of one of said variable volume chambers while decreasing the volume of the other of said variable volume chambers.

2. A fluid motor as claimed in claim 1 wherein said fluid conveying means includes an elongated tube extending within an axial through bore in said piston.

3. A fluid motor as claimed in claim 2 wherein said portion passage includes a peripheral clearance between said bore and said tube.

4. A fluid motor as claimed in claim 1 wherein said chambers are located adjacent axially opposed end portions of said piston.

5. A fluid motor as claimed in claim 4 wherein the volume of each of said chambers is variable by the movement of said opposed end portions into and out of the respective chamber adjacent thereto during the reciprocal movement of said piston.

6. A fluid motor as claimed in claim 1 wherein said heat transfer medium is a gas.

7. A fluid motor as claimed in claim 6 wherein said gas is pressurized.

8. A fluid motor as claimed in claim 1 wherein said motor is the motor of a fluid operable rock drill and said piston is a hammer piston reciprocal for repetitive impacting on an impact member of said drill.

9. A fluid motor as claimed in claim 1 wherein said containment means is adapted to contain a predetermined fixed quantity of such heat transfer medium.

10. A fluid motor as claimed in claim 1 wherein said containment means is a constant volume containment means.

11. A fluid motor as claimed in claim 1 wherein said containment means is isolated from said motive fluid conducting means in a manner to preclude fluid flow therebetween.

12. A fluid motor as claimed in claim 11 wherein said containment means additionally is isolated from the environment exterior to said body member.

* * * * *

UNITED STATES PATENT OFFICE
CERTIFICATE OF CORRECTION

PATENT NO. : 4,174,010
DATED : November 13, 1979
INVENTOR(S) : George A. Hibbard It is certified that error appears in the above-identified patent and that said Letters Patent are hereby corrected as shown below:

Claim 3, line 30, change the words "portion passage" to read --passage portion--.

Signed and Sealed this

*Eighth* Day of *April 1980*

[SEAL]

*Attest:*

SIDNEY A. DIAMOND

*Attesting Officer*

*Commissioner of Patents and Trademarks*